US007367152B2

(12) United States Patent
Samson

(10) Patent No.: US 7,367,152 B2
(45) Date of Patent: May 6, 2008

(54) PIVOTING MOUNT FOR A FIREARM ACCESSORY

(76) Inventor: Scott W. Samson, 11 Echo Cove Way, Spofford, NH (US) 03462

( * ) Notice: Subject to any disclaimer, the term of this patent is extended or adjusted under 35 U.S.C. 154(b) by 112 days.

(21) Appl. No.: 11/275,770

(22) Filed: Jan. 27, 2006

(65) Prior Publication Data

US 2006/0162227 A1 Jul. 27, 2006

Related U.S. Application Data

(60) Provisional application No. 60/647,622, filed on Jan. 27, 2005.

(51) Int. Cl.
*F41G 1/387* (2006.01)

(52) U.S. Cl. ..... 42/128; 42/148

(58) Field of Classification Search ..... 42/124, 42/127, 128, 147, 148
See application file for complete search history.

(56) References Cited

U.S. PATENT DOCUMENTS

| | | | | |
|---|---|---|---|---|
| 944,916 | A | 12/1909 | Shepard | |
| 1,083,288 | A | 1/1914 | Lowe | |
| 2,115,618 | A | 4/1938 | Carl | 33/50 |
| 2,367,762 | A * | 1/1945 | Eiane | 42/148 |
| 2,425,130 | A | 8/1947 | Shelley | 42/1 |
| 2,445,087 | A | 7/1948 | Rogers | 33/50 |
| 2,527,289 | A | 10/1950 | Allen | 33/50 |
| 2,529,801 | A | 11/1950 | Fisk | 33/50 |
| 2,571,935 | A | 10/1951 | Pachmayr et al. | 33/50 |
| 2,629,175 | A | 2/1953 | Merritt | 33/50 |
| 2,639,507 | A * | 5/1953 | Pachmayr | 42/128 |
| 2,644,237 | A * | 7/1953 | Pachmayr | 42/128 |
| 2,710,453 | A | 6/1955 | Beverly | 33/50 |
| 2,803,880 | A * | 8/1957 | Weaver | 42/128 |
| 4,092,793 | A * | 6/1978 | Ricks | 42/128 |
| 4,092,899 | A * | 6/1978 | Lienau | 89/1.816 |
| 4,461,087 | A | 7/1984 | Norman | 33/249 |
| 6,705,037 | B2 * | 3/2004 | Van Kirk | 42/126 |
| 2003/0192224 | A1 * | 10/2003 | Kirk | 42/124 |
| 2004/0244263 | A1 | 12/2004 | Pettersson et al. | 42/128 |

* cited by examiner

*Primary Examiner*—Bret Hayes
(74) *Attorney, Agent, or Firm*—Barlow, Josephs & Holms, Ltd.

(57) ABSTRACT

A pivoting accessory mount used for attaching auxiliary devices such as sighting devices to a firearm. The accessory mount includes a base member that attaches to the firearm and includes a mounting support and a shaft. An accessory receiver is pivotally received and retained about the shaft. The accessory receiver is pivotable between an inactive position along the side of the upper receiver of the firearm and an active position extending substantially vertically relative to and in alignment with the upper receiver of the firearm. The mounting shaft is linearly displaceable, thereby engaging the accessory receiver when in the active position to prevent accidental displacement of the accessory receiver.

16 Claims, 6 Drawing Sheets

PIVOTING MOUNT FOR A FIREARM ACCESSORY

CROSS-REFERENCE TO RELATED APPLICATIONS

This application is related to and claims priority from earlier filed U.S. Provisional Patent Application No. 60/647,622, filed Jan. 27, 2005, the contents of which are incorporated herein by reference.

BACKGROUND OF THE INVENTION

The present invention relates generally to a pivoting mounting assembly for interfacing accessories with firearms. More specifically, the present invention is related to a pivoting mount for a firearm accessory that allows the user to mount an accessory in a manner wherein the user can selectively pivot the accessory between an active position and an inactive position thereby providing for rapid changes between desired accessories.

In the prior art there is a broad range of accessories that are mounted onto a firearm to provide increased accuracy or broader functionality. Similarly, many accessories are available that are configured to be paired with another accessory wherein the combination provides for an enhanced use. In this context for example, there are telescopic extenders that serve to magnify the objective image as seen in a telescopic sight. It should be appreciated that in general an accessory such as the type intended to be described herein includes all types of sighting devices capable of being mounted onto a firearm, including but not limited to telescopic sights, optical sights, night vision devices, range finding and illuminating devices as well as various laser devices and directed fire equipment.

Often there is also a need to provide an accessory that includes several configurations or is provided in two parts such as for example an optical scope with a secondary power multiplier or extender. This would also hold true in many other cases, such as, for example an infrared or night vision device that is used in conjunction with an optical scope. As can be appreciated, when using such a two-part device, there are times when the user needs only the optical scope and there are other times when the user requires the combination of both an auxiliary accessory like a multiplier and the optical scope, therefore creating a need for at least the accessory component to be easily moved out of the way when not in use. It can also be appreciated that with such an arrangement, while the components of the sighting system must be movable, they must also be reliably aligned when placed back into their active positions.

In order to interface these accessory devices with prior art firearms, such as rifles, shotguns, black-powder weapons and handguns, there are typically spaced apart attachment points that are provided along the top surface of the receiver or barrel of the firearm, which are used for attaching accessory devices. Such mounting devices serve to position the accessory in a convenient location above the barrel of the firearm while allowing the accessory to be placed in alignment with the longitudinal axis of the firearm. This positioning is particularly important when the accessory is a scope or another sighting device, because this positioning also allows the sighting scope to be mounted in a convenient location for the user while allowing the scope to be aligned with the barrel of the firearm. The scope is then sighted relative to the firearm to provide an accurate and positive alignment between the aiming point of the sight and the barrel of the firearm. In addition to providing mounting points along the top of the firearm, many modern combat rifles include an extended rail interface that is formed along the top of the firearm receiver and often further includes a mounting rail, which extends over the barrel of the rifle. In this manner, the rail provides a modular interface assembly to which the various accessories can be clamped.

In this regard, there are a number of different types and configurations of sight mounting devices that allow the sight to be removed from and replaced on to the firearm, each of which includes its own design problems and disadvantages. Prior art mounting devices typically encompass and hold a sighting scope in a scope holding portion which is then attached to a base that is in turn mounted to the attachment points or rail interface on the receiver of a firearm. The standard and most widely used method for mounting scopes on firearms consists of a combination of a scope base and scope rings. A scope base is a platform securely attached to the firearm to provide a pre-configured mounting platform for the rings. The rings are typically formed as individual, horizontally split cylindrical clamps fastened around the scope body or "tube", with lower mounting portions which can be removably secured to the base. These types of mounting devices are generally mounted using a variety of screw fasteners requiring the use of a tool, such as a screwdriver, to firmly seat the scope holding portion on the base or to remove the scope holding portion from the base. Thus, it is often difficult and time consuming to attach or remove the scope from the base.

Additionally, there are many different scope ring/base combinations that are available in the prior art. One popular style known to those skilled in the art is the "Weaver" system, which utilizes longitudinal rail-type bases and rings that wrap around the barrel of the scope and are then transversely clamped to the rails. Another mounting configuration is the popular "rotary dovetail" style in which a base is provided with a ring-receiving slot, and a mating dovetail portion of the scope ring is dropped into the slot and rotated 90° into locking alignment with the receiver and barrel. Yet another style is the "Ruger® dovetail" system in which a dovetail "base" is actually machined into the firearm's receiver, and specially mated rings are clamped on with heavy screws.

There is therefore a need to provide a mounting arrangement that gives the user the ability to move at least a portion of a sighting device into an inactive position until the user requires it, while further providing for the device to remain reliably aligned when replaced in the active position. Further, the device must be easily and quickly deployable so that in combat situations the sighting device can be deployed rapidly with reliable and repeatable results.

BRIEF SUMMARY OF THE INVENTION

In this regard, the present invention provides a modular accessory mount that interfaces with the desired accessory and allows the accessory to be reliably and repeatedly moved between an active position and an inactive position. In accordance with the present invention, a new and novel pivoting accessory mount is provided for use with a variety of sighting scopes such as are used on prior art firearms including, civilian and military rifles, shotguns, black-powder weapons and handguns. The pivoting mount of the present invention is useful for mounting one or both of a primary optical sight and for a secondary sighting accessory. For example, an optical scope may be mounted using the pivoting mount thereby allowing the scope to be pivoted to the side should the user wish to use the open sights on the firearm while also allowing the scope to be quickly positioned into the active position when needed. Similarly, an accessory sighting device can be mounted fir coordinated use with a primary sighting device using the pivot mount of the present invention, wherein the accessory can be pivoted out of the way when not needed but can also be quickly deployed when desired by the user.

The pivoting accessory mount of the present invention is designed to allow quick and easy engagement and disengagement of accessory devices, such as sighting devices, on prior art firearms without the need to re-adjust or re-zero the accessory each time it is deployed. The present invention also includes features that allow it to be tailored particularly for use in the modern type sporting rifle that includes some form of receiver rail mounting system in that the present invention can include modular interface components that make it particularly flexible and customizable for a variety of applications.

Generally the pivoting accessory mount of the present invention includes a mounting base that is configured for mounting onto a firearm. In particular, the mounting base includes a lower portion that is tailored to the application with which it will be used. For some applications this means that the lower portion will be configured for fastening using screws. In other applications the lower portion may include a clamping assembly. In all cases, the upper portion of the mounting base is configured and arranged to receive and support an accessory receiver into which the accessory is placed and retained. The accessory receiver is pivotably attached to the mounting base and is pivotable between a first engaged position and a second disengaged position. Additionally, the accessory receiver is provided with a locking mechanism that serves to retain the accessory receiver in the deployed position until the locking mechanism is disengaged.

Accordingly, it is an object of the present invention to provide a pivoting mount for a firearm accessory. It is a further object of the present invention to provide a pivoting mount for a firearm accessory that has an engaged position that ensures positive alignment and repeatable results after multiple operations. It is still a further object of the present invention to provide a pivoting mount for a firearm accessory that is highly durable and easily operable to allow a user quick and positive operation between an engaged and disengaged position.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 2A:
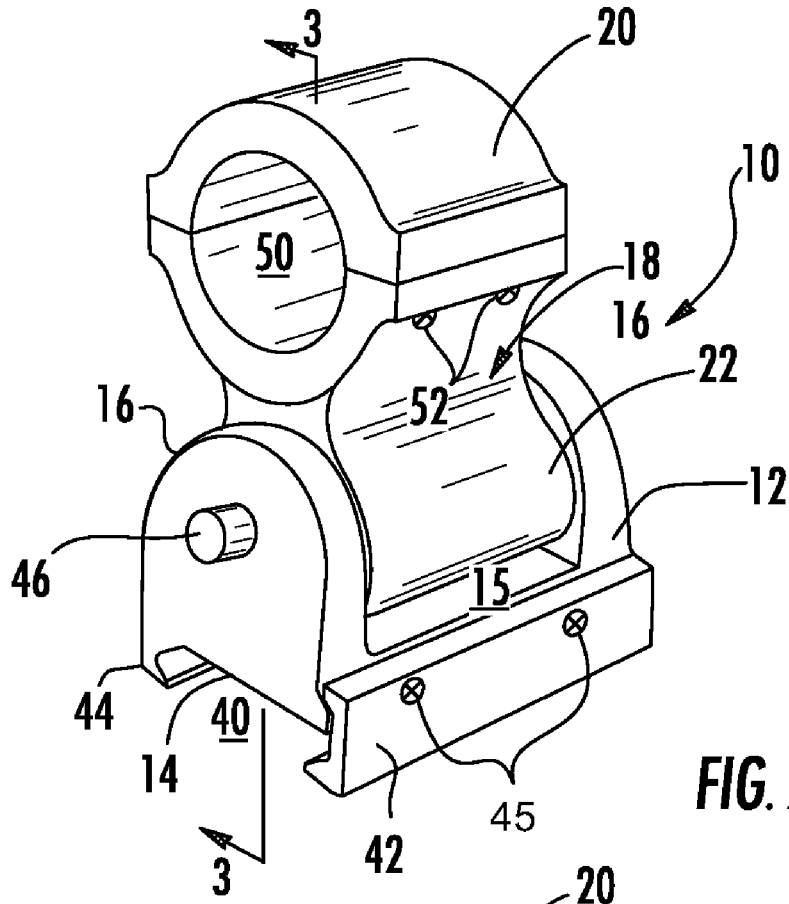
FIG. 2*a* is a front, perspective view of the pivoting accessory mount of the present invention in the engaged position.

Now referring to the drawings, the pivoting accessory mount system of the present invention is shown and generally illustrated in the figures. As can be seen in FIG. 2*a* the pivoting accessory mount 10 generally includes a base member 12 having a bottom surface 14 configured to engage a firearm and a top surface 15 that includes at least one support element 16 extending upwardly therefrom. In addition, the accessory mount 10 includes an accessory receiver 18 with an upper portion 20 that forms an accessory clamp and a bottom portion 22 for interfacing with a mounting shaft 24 and attaching the accessory receiver 18 to the base member 12 as will be described in detail below.

Figure 1:
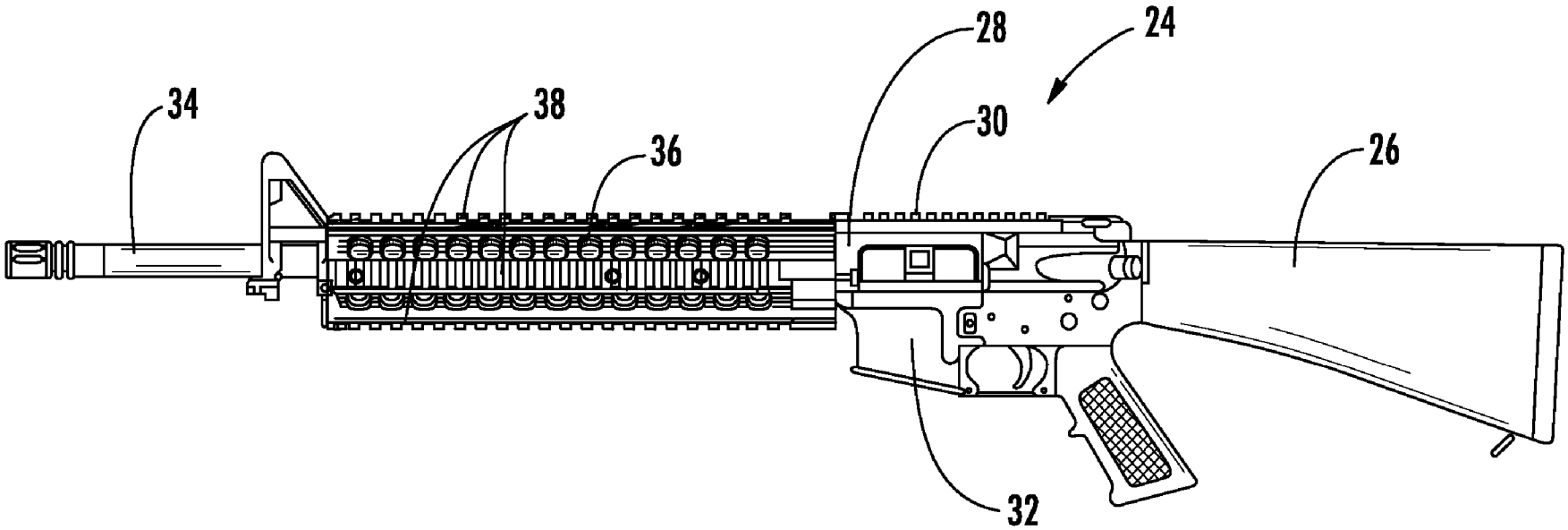
FIG. 1 is a side view of a military combat firearm with a fore-end rail installed around the firearm barrel.

The accessory mount 10 of the present invention is intended for use with any known type of firearm including handguns, black powder weapons, sporting rifles and military rifles. For the purpose of illustration a typical military combat firearm 24 is depicted in FIG. 1. A conventional combat firearm 24 generally includes a conventional stock 26,an upper receiver 28 with a flattop 30, a lower receiver 32 and a barrel 34. The barrel 34 is joined to the upper receiver 28. The barrel 34 defines the forward portion of the firearm 24 and the stock 26 defines the rearward portion of the firearm 24. The longitudinal axis of the firearm 24 runs from stock 26 through receiver 28 to the barrel 34. In place of the traditional hand guards that are typically provided on this type of firearm 24, a fore-end rail assembly 36 is shown installed in front of the upper receiver 28 and around the barrel 34. Such a fore-end rail assembly 36 provides a user with additional interface rails 38 to which various firearm accessories can be mounted via a modular interface system as is well known in the prior art.

Turning now to FIG. 2, as was stated above, the present invention provides a pivoting accessory mount 10 for interfacing various accessories with a firearm 24. In particular, the present invention provides an accessory mounting system that allows easy engagement and disengagement of various accessory devices in a rapid manner that further eliminates the need for realigning the accessory after each deployment. The accessory mount 10 principally includes a mounting base 12 and an accessory receiver 18 that is pivotally attached to the mounting base 12. The mounting base 12 is further configured for attachment to a firearm 24 such as by clamping onto an interface rail 30, 38.

To facilitate attachment of the mounting base 12 to a firearm 24, the bottom 14 of the mounting base 12 is formed to include a mounting channel 40 and a clamping device 42. The mounting channel 40 is formed in a shape that is particularly suited to engage the standard dovetail shaped interface rail or Weaver type interface rail that is provided on the top of the firearm receiver or on the extension rail system as described in the prior art. The mounting channel 40 is shown to include one fixed side 44 and a second movable side 42 that is attached to the base 12 using fasteners 45. In this manner, the fixed side 44 and movable side 42 cooperate as a clamp to engage the dovetail interface and retain the mounting base 12 in a fixed position on the rail interface. Similarly, the bottom 14 of the base 12 may be machined in a manner that allows the base 12 to be mated with a separate clamping mechanism. The mounting base 12 would then be attached to an auxiliary clamping mechanism using fasteners such as screws. The auxiliary clamping mechanism would then serve as the means by which the mounting base 12 is attached to the rail interface. In either configuration, this disclosure is provided to simply illustrate some of the means by which the mounting base 12 can be attached to the firearm 24. For example, the mounting base 12 may be configured to be attached directly to the firearm 24 upper receiver 28 or barrel 34 using screws that engage mounting lugs provided on the firearm 24 itself or bands that extend around and engage the barrel 34 of the firearm 24. It can be appreciated by one skilled in the art that there are numerous other possibilities that exist for attaching the mounting base 12 to the firearm 24, all of which are intended to fall within the scope of the present invention.

The mounting base 12 is configured to include at least one support element 16 extending upwardly therefrom. The at least one support element 16 has a mounting shaft 46 that extends therefrom substantially parallel to the longitudinal axis and the barrel 34 of the firearm 24 when the pivoting accessory mount 10 is installed onto the firearm 24. The mounting shaft 46 is configured to receive and retain the accessory receiver 18 as will be described in more detail below. In the preferred embodiment, the mounting base 12 can be seen to include first and second support elements 16 extending upwardly from a forward and rearward edge thereof. In this case the mounting shaft 46 extends between and is supported by both the first and second mounting elements 16.

Figure 2B:
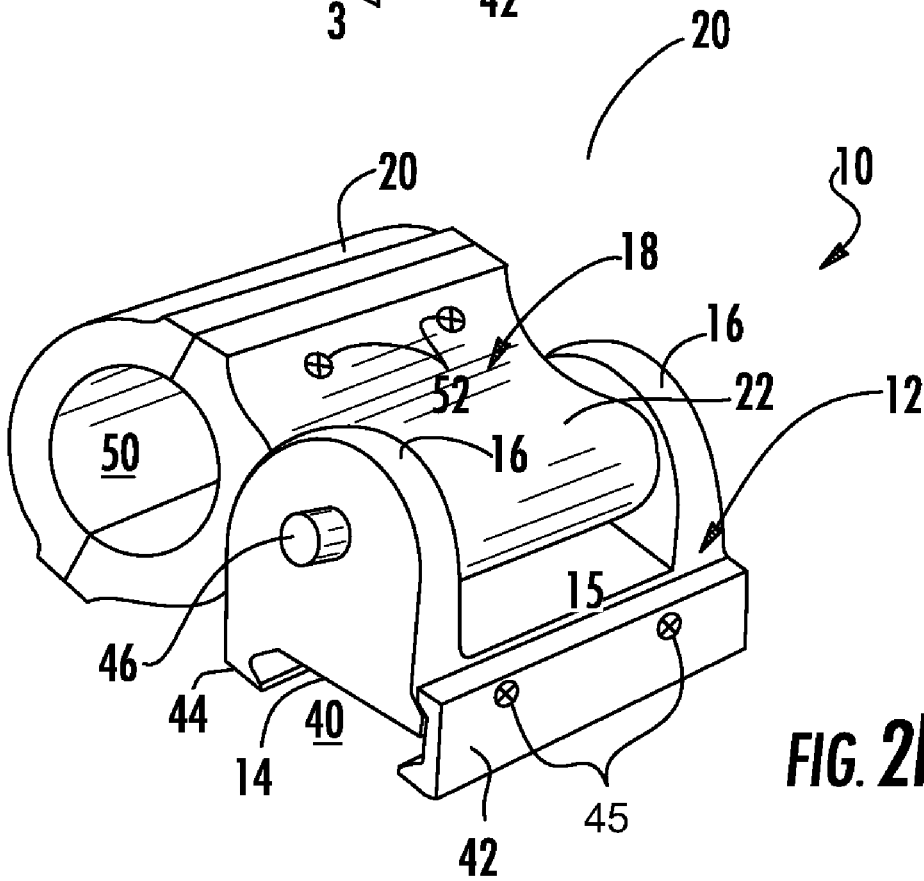
FIG. 2*b* is a front, perspective view of the pivoting accessory mount of the present invention in the disengaged position.
Figure 4A:
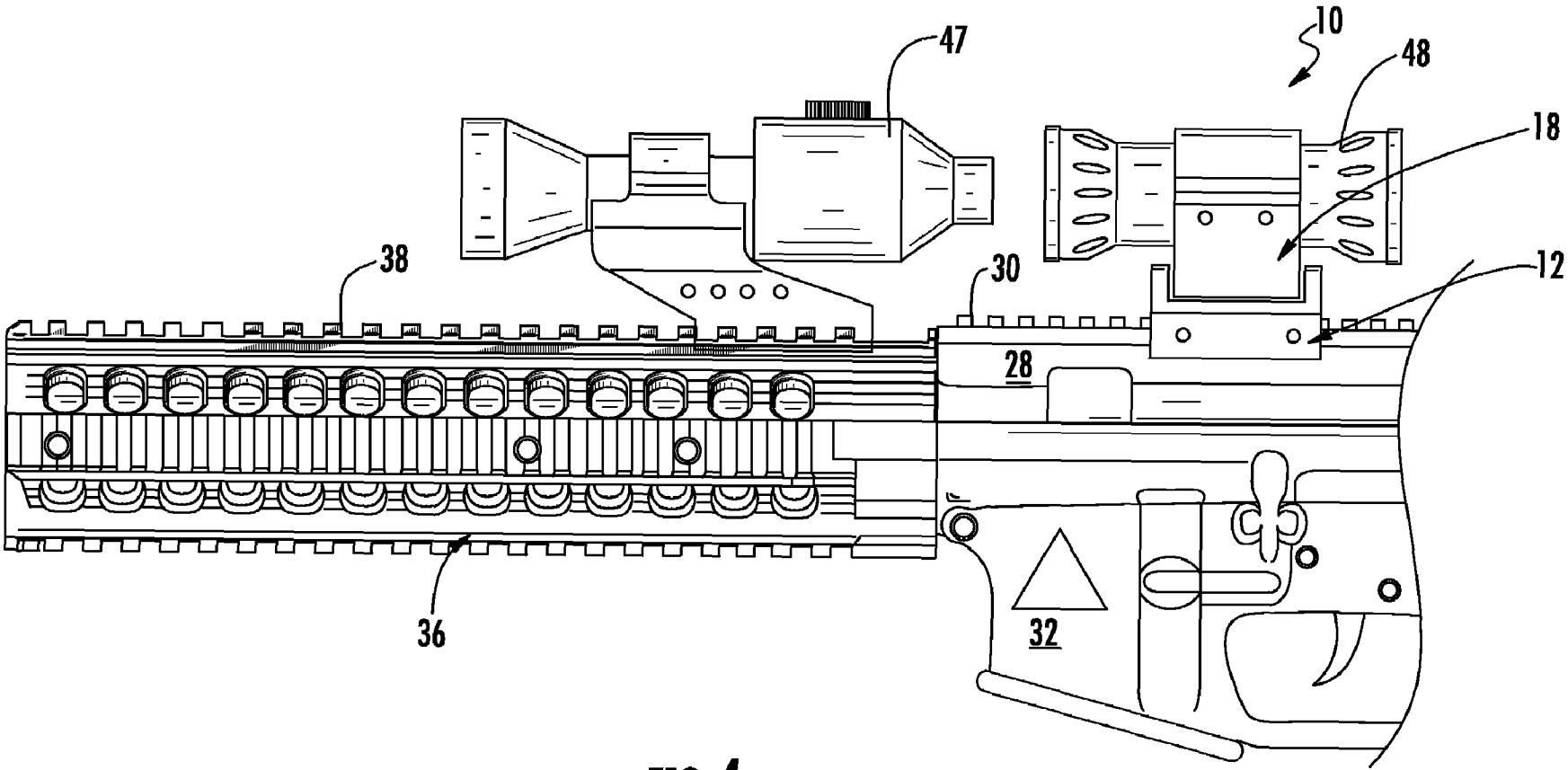
FIG. 4*a* is a side view of the pivoting accessory mount installed onto a firearm in the engaged position.
Figure 4B:
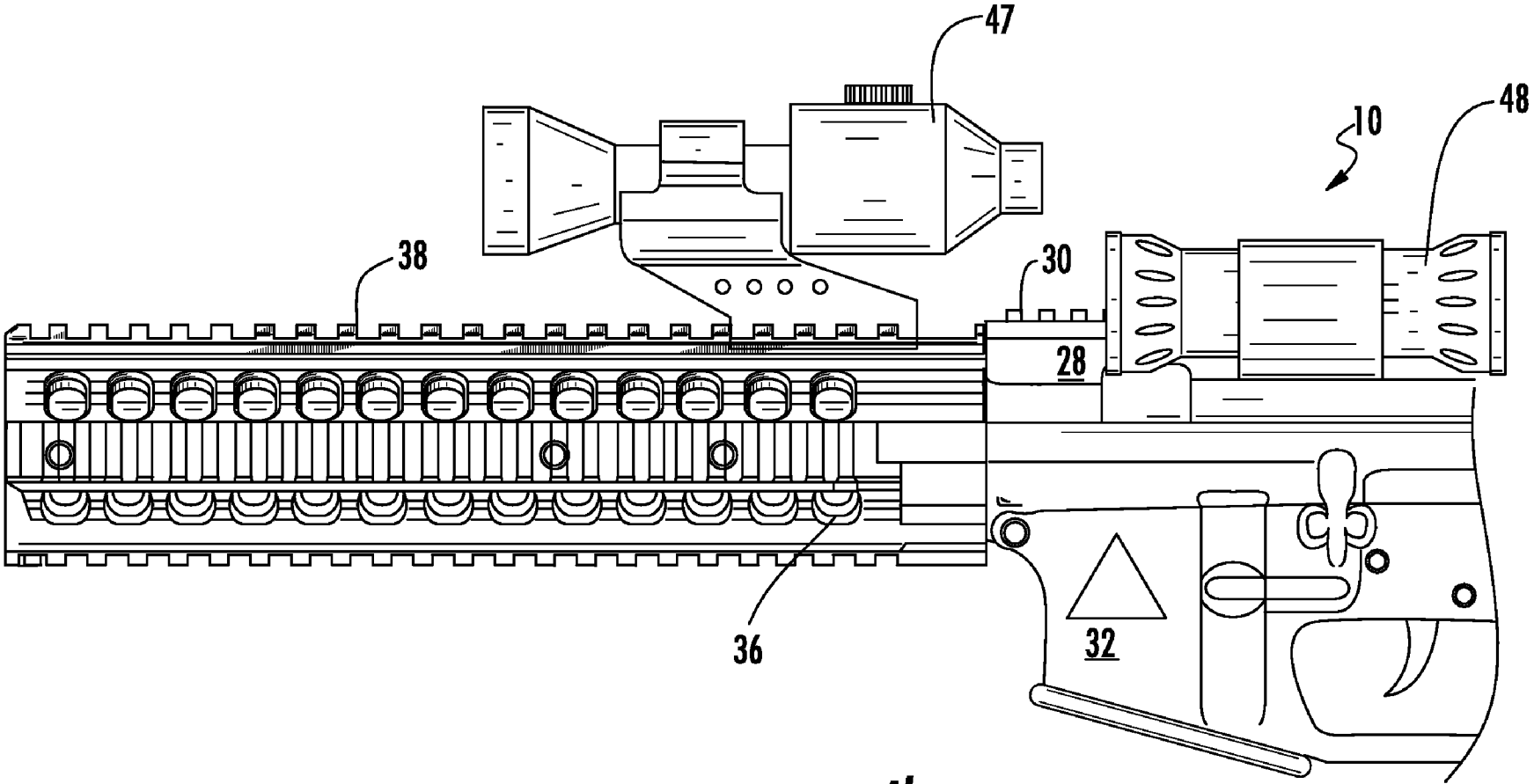
FIG. 4*b* is a side view of the pivoting accessory mount installed onto a firearm in the disengaged position.

The accessory receiver 18 is pivotally mounted to the base member 12 such that when the base member 12 is attached to the firearm 24, the accessory receiver 18 can be pivoted between an engaged position (as is shown in FIGS. 2*a* and 4*a*) and a disengaged position (as is shown in FIGS. 2*b* and 4*b*). Generally, the axis around which the accessory receiver 18 pivots is aligned with and parallel to the longitudinal axis of the firearm 24. Additionally, the location of the mounting shaft 46 within the accessory mount 10 is positioned such that the engaged position brings the accessory receiver 18 into a position above the interface rail 30, 38 of the firearm 24 and the disengaged position allows the accessory receiver 18 to pivot to one side (preferably the side opposite the shell discharge port) thereby positioning the accessory receiver 18 out of line of sight along the top of the firearm 24. This allows a clear line of sight for a user who desires to use the open sights of the firearm 24 or a primary sighting device 47 should the pivoting accessory mount 10 be holding a secondary sighting device.

The top portion 20 of the accessory receiver 18 serves as the interface between the mounting base 12 and the accessory device 48. The top portion 20 of the accessory receiver 18 is formed as a two-part clamp that includes a circular opening 50 into which a sighting device 48 such as a scope can be clamped. Fasteners such as screws 52 are used to attach the top portion 20 of the clamp onto the accessory receiver 18. While a two-part clamp is shown, it should be appreciated by one skilled in the art that numerous other alternate configurations could be employed to suit the particular accessory device that is to be mounted into the accessory receiver 18.

Figure 3:
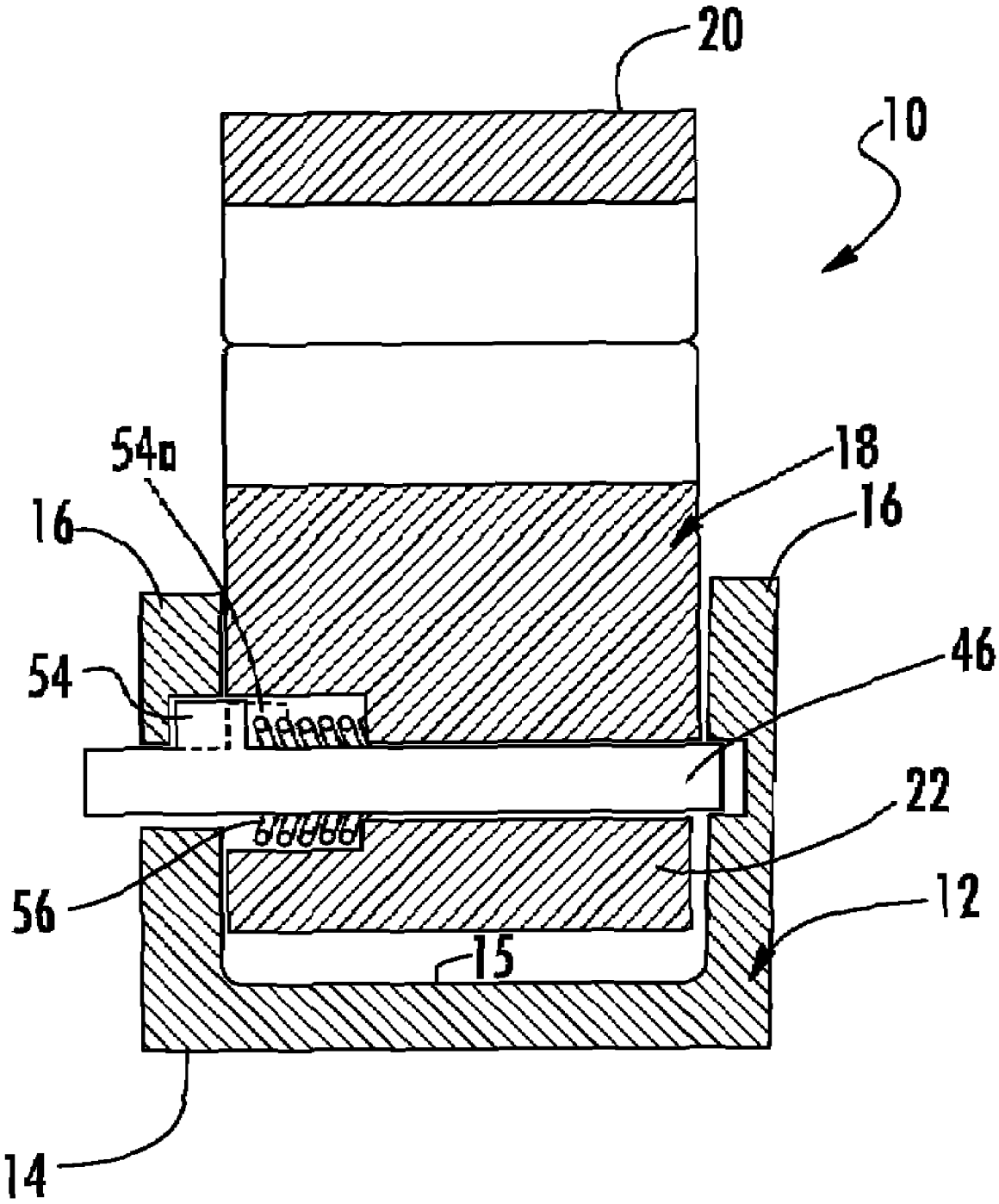
FIG. 3 is a cross sectional view of the pivoting accessory mount taken along line 3-3 of FIG. 2*a;*

Turning to FIG. 3, it can be seen that a locking means 54 is provided in the interface between the accessory receiver 18 and the mounting base 12. The locking means 54 is operable to selectively retain or release the accessory receiver 18 thereby allowing the accessory receiver 18 to be reliably and selectively moved from an engaged position and a disengaged position. In particular, the mounting shaft 46 can be see to be depressible in a manner that, when depressed, the shaft 46 moves either a locking pin 54 or a ratchet assembly into position 54*a* (shown in dotted lines) out of contact with the support member 16 thereby allowing the accessory receiver 18 to be moved between the engaged and disengaged positions. When the mounting shaft 46 is released it returns the locking means 54 back to its original position and reengages the support member 16 and/or the accessory receiver 18 thereby preventing it from being accidentally moved. Further, a spring 56 is provided to create a spring bias force that urges the mounting shaft 46 in a linear direction towards the locked or engaged position. It should be appreciated that the locking function may also be formed separately from the mounting shaft 46 and still fall within the scope of the present invention. Similarly, pulling the shaft 46 outwardly rather than depressing the shaft 46 may accomplish the unlocking function.

Turning now to FIGS. 4*a* and 4*b*, the accessory device 48 is mounted into the accessory receiver 18 and the entire assembly is installed onto firearm 24. As was stated above, the accessory device 48 may be the primary optical sight on a firearm 24, whereby the optical sight can be pivoted into an engaged position over the rail interface 30, 38 of the firearm 24 and in alignment with the barrel 34 of the firearm 24 or in a disengaged position alongside the firearm 24 wherein the optical sight will not obstruct use of the open sights provided on the firearm 24. Similarly, the accessory device 48 may be a power multiplier or night vision accessory that will be used in conjunction with an optical scope 47 that is already mounted on the firearm 24. In another arrangement, both the primary 47 and secondary accessory 48 may both be mounted onto the firearm 24, each using the pivotable mount 10 of the present invention.

Figure 5A:
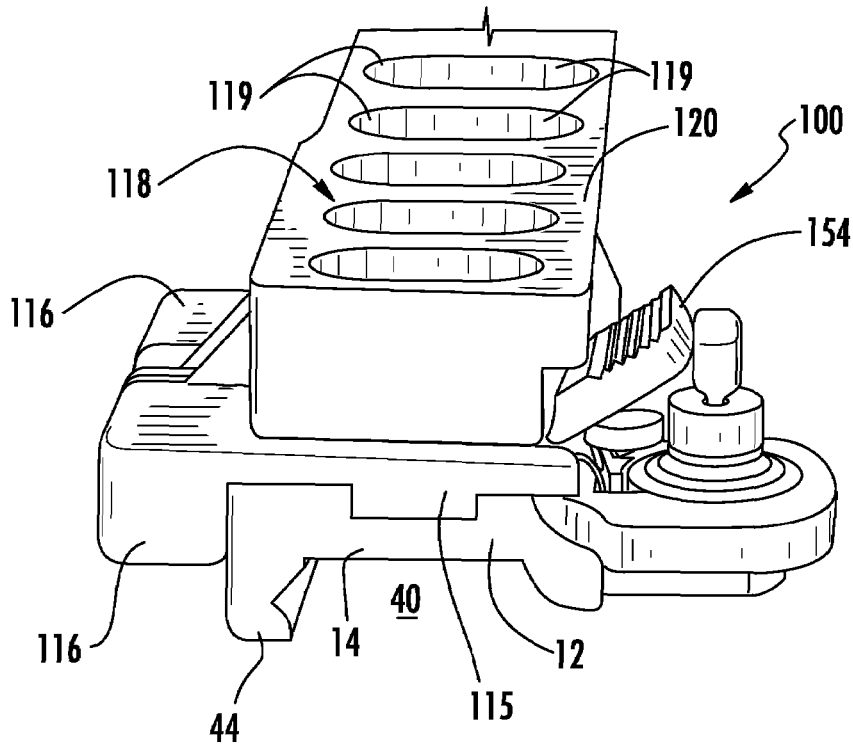
FIG. 5*a* is a front, perspective view of an alternate embodiment pivoting accessory mount of the present invention in the engaged position.
Figure 5B:
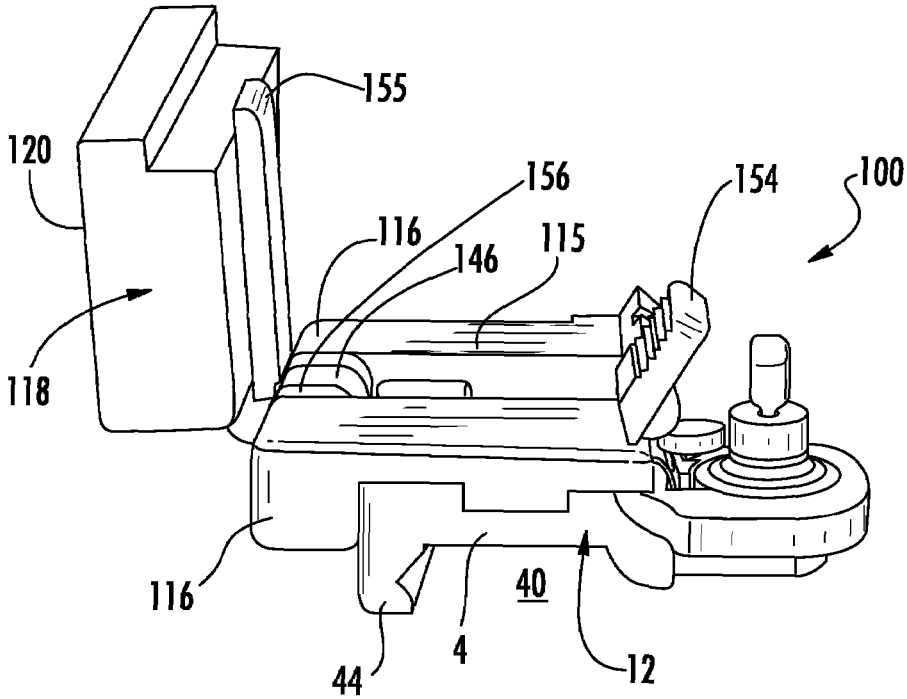
FIG. 5*b* is a front, perspective view of the alternate embodiment pivoting accessory mount of the present invention in the disengaged position.

FIGS. 5*a* and 5*b* depict an alternate embodiment pivoting accessory mount at 100. As stated above, the mounting base 12 is shown to be formed in two pieces wherein the lower portion 14 of the mounting base 12 is formed as a clamping member and functions as described above. The upper portion 115 of the mounting base 12 is configured to include at least one support element 116 extending outwardly to one side thereof. The at least one support element 116 has a mounting shaft 146 that extends therefrom substantially parallel to the longitudinal axis and the barrel 34 of the firearm 24 when the pivoting accessory mount 100 is installed onto the firearm 24. The mounting shaft 146 is configured to receive and retain the accessory receiver 118 as will be described in more detail below. In this particular embodiment, the mounting base 12 can be seen to include first and second support elements 116 extending out to the side of the mounting base 12 from a forward and rearward edge thereof. In this case the mounting shaft 146 extends between and is supported by both the first and second mounting elements 116.

The accessory receiver 118 is pivotally mounted to the base member 12 such that when the base member 12 is attached to the firearm 24, the accessory receiver 118 can be pivoted between an engaged position (as is shown in FIG. 5*a*) and a disengaged position (as is shown in FIG. 5*b*). Generally, the axis around which the accessory receiver 118 pivots is aligned with and parallel to the longitudinal axis of the firearm 24. Additionally, the location of the mounting shaft 146 within the accessory mount 100 is again positioned such that the engaged position brings the accessory receiver 118 into a position above the interface rail 30, 38 of the firearm 24 and the disengaged position allows the accessory receiver 118 to pivot to one side (preferably the side opposite the shell discharge port) thereby positioning the accessory receiver 118 out of line of sight along the top of the firearm 24. This allows a clear line of sight for a user who desires to use the open sights of the firearm 24 or a primary sighting device 47 should the pivoting accessory mount 10 be holding a secondary sighting device.

The top portion 120 of the accessory receiver 118 serves as the interface between the mounting base 12 and the accessory device 48. The top portion 120 of the accessory receiver 118 is formed as a mounting pad onto which a sighting device 48 such as a scope is fastened. Fasteners such as screws (not shown) can be used to attach the accessory device 48 to the top portion 120 of the accessory receiver 118 via holes 119.

In this embodiment pivoting accessory mount 100 includes a locking means 154 is provided at an edge of the mounting base 12 opposite the mounting shaft 146. The locking means 154 is operable to selectively retain or release the accessory receiver 118 thereby allowing the accessory receiver 118 to be reliably and selectively moved from an engaged position and a disengaged position. In particular, the locking mechanism 154 can be see to be depressible in a manner that, when depressed, the locking mechanism 154 is displaced to allow a locking tab 155 on the accessory receiver to pass freely thereby allowing the accessory receiver 118 to be moved between the engaged and disengaged positions. A spring 156 is provided that urges the accessory receiver 118 to a disengaged position by applying a spring bias. Accordingly, when the locking mechanism 154 is depressed, the accessory receiver 118 is displaced to the disengaged position by the spring 156. Additionally, the locking means 154 is spring biased so that it returns back to its original position prepared to reengage the tab 155 as the accessory receiver 118 is returned to the engaged position. As was stated above, it should be appreciated that the locking function may also be formed using any other methods known to those skilled in the art and still fall within the scope of the present invention.

It can therefore be seen that the present invention provides a reliable and easy to use pivoting accessory mount for a firearm that serves to allow an accessory to be quickly and reliably moved between a disengaged position and an engaged position while eliminating the need for recalibration and alignment. Further, the present invention can be modified to accommodate a number of different types of firearm accessories as well as being suited for mounting onto any type of known firearm configurations. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A pivoting accessory mount for use with a firearm, comprising:

a base member having a front edge, a rear edge, a longitudinal axis extending between said front edge and said rear edge, a bottom surface and a top surface, said bottom surface configured to be mounted on an upper receiver of said firearm wherein said longitudinal axis of said mounting base is in substantial alignment with a barrel of said firearm, said top surface having supporting structure extending upwardly therefrom;

a mounting shaft supported by and extending through said supporting structure, said mounting shaft having a central axis that is substantially parallel to said longitudinal axis;

an accessory clamp having an upper section and a lower section, said upper section including an interface for receiving and retaining a firearm accessory, said lower section configured to be received about said mounting shaft, wherein said accessory clamp can be pivoted about said mounting shaft between a first, inactive position adjacent the firearm and a second, active position protruding substantially vertically from said firearm, wherein said mounting shaft is linearly displaceable along said central axis between a latched position and a released position, wherein said mounting shaft in said latched position engages said supporting structure and said accessory clamp thereby preventing said accessory clamp from pivoting relative to said base member.

2. The pivoting accessory mount of claim 1, wherein said mounting shaft is spring biased toward said latched position and selectively depressible toward said released position.

3. The pivoting accessory mount of claim 1, said supporting structure further comprising:

a first support element extending upwardly from the front edge of the base member and a second support element extending upwardly from the rear edge of the base member, wherein said mounting shaft extends between and is supported by said first and second support elements, wherein said lower section of said accessory clamp is received about said mounting shaft and is positioned between said first and second support elements.

4. The pivoting accessory mount of claim 1, wherein said bottom surface of said base member is a clamping device configured to interface with a Weaver type interface rail.

5. The pivoting accessory mount of claim 1, wherein said base member includes clamping means to interface directly with the upper receiver of said firearm.

6. The pivoting accessory mount of claim 1, wherein said base member includes clamping means to interface with a supplemental rail system mounted on said firearm.

7. The pivoting accessory mount of claim 1, wherein said firearm accessory is a sighting device.

8. The pivoting accessory mount of claim 1, wherein said firearm accessory is a secondary sighting device configured for use in conjunction with a primary sighting device also mounted on said firearm.

9. A pivoting aiming sight mount for use with a firearm, said sight mount including a sight receiver that protrudes generally vertically from the firearm when being used and adjacent the side of the firearm when not in use, said pivoting aiming sight mount comprising:

a base member having a front edge, a rear edge, a longitudinal axis extending between said front edge and said rear edge, a bottom surface and a top surface, said bottom surface configured to be mounted on an upper receiver of said firearm wherein said longitudinal axis of said mounting base is in substantial alignment with a barrel of said firearm, said top surface having supporting structure extending outwardly therefrom;

a mounting shaft supported by and extending through said supporting structure, said mounting shaft having a central axis that is substantially parallel to said longitudinal axis;

a sight receiver having an upper section and a lower section, said upper section including an interface for receiving and retaining a sighting device, said lower section configured to be received about said mounting shaft, wherein said sight receiver can be pivoted about said mounting shaft between a first, inactive position adjacent the side of the firearm and a second, active position protruding substantially vertically from said firearm, wherein said mounting shaft is linearly displaceable along said central axis between a latched position and a released position, wherein said mounting shaft in said latched position engages said supporting structure and said sight receiver thereby preventing said sight receiver from pivoting relative to said base member.

10. The pivoting aiming sight mount of claim 9, wherein said supporting structure extends upwardly from said from said mounting base.

11. The pivoting aiming sight mount of claim 10, said supporting structure further comprising:

a first support element extending upwardly from the front edge of the base member and a second support element extending upwardly from the rear edge of the base member, wherein said mounting shaft extends between and is supported by said first and second support elements, wherein said lower section of said sight receiver is received about said mounting shaft and is positioned between said first and second support elements.

12. The pivoting aiming sight mount of claim 9, wherein said mounting shaft is spring biased toward said latched position and selectively depressible toward said released position.

13. The pivoting aiming sight mount of claim 9, wherein said supporting structure extends outwardly to a first side of said mounting base.

14. A mounting assembly for use with a firearm, comprising:

a base member having a bottom surface and a top surface, and further having a longitudinal axis, said bottom surface being configured and arranged to selectively engage with a dovetail rail interface on a firearm, said top surface having supporting structure extending upwardly therefrom;

a clamp assembly having an upper section and a lower section, said lower section including a pivot shaft rotatably mounted to said supporting structure of said base member, said pivot shaft extending parallel to said longitudinal axis of said base member, said upper section including an interface configured and arranged to selectively receive and retain a telescopic sight parallel to said longitudinal axis of said base member, said clamp assembly being rotatably movable relative to said supporting structure between an inactive position and an active sighting position, and a latching assembly configured and arranged to selectively retain said clamp assembly in said inactive and active positions, said shaft being linearly moveable along an axis thereof relative to said supporting structure such that said clamping assembly is movable between a latched position, and an unlatched position, said latching assembly including a spring captured between said lower section of said clamping assembly and said supporting structure, said spring normally biasing said clamping assembly to said latched position.

15. The mounting assembly of claim 14 wherein said latching assembly comprises a locking pin protruding from said shaft, said shaft being linearly moveable along an axis thereof relative to said supporting structure such that said clamping assembly is movable between a latched position wherein said locking pin is engaged with said supporting structure, and an unlatched position wherein said locking pin is disengaged from said supporting structure.

16. A mounting assembly for use with a firearm, comprising:

a base member having a bottom surface and a top surface, said bottom surface including a mounting channel configured and arranged to be seated on a dovetail rail, and a clamping assembly configured and arranged to selectively engage with said dovetail rail and retain said base member on said dovetail rail;

an accessory receiver plate having an upper surface and a lower surface, said accessory receiver plate being rotatably mounted to said base member along adjacent side edges thereof, said upper surface including an interface configured and arranged to selectively receive and retain a weapon accessory, said accessory receiver plate being rotatably moveable between an active position wherein said upper surface thereof is in substantially parallel relation with said top surface of said base member, and an inactive position;

a spring captured between said base member and said accessory receiver plate, said spring normally biasing said accessory receiver plate to said inactive position, a latching assembly configured and arranged to selectively retain said accessory receiver plate in said active position, said latching assembly including a locking tab on said accessory receiving plate and a release mechanism on said base member, said release mechanism being movable between a latching position wherein said release mechanism engages said locking tab and retains said accessory receiver plate in said active position, and a release position wherein said locking tab is disengaged from said release mechanism and said accessory mounting plate is free to automatically rotate to said inactive position responsive to a bias of said spring.

* * * * *